US009677825B2

(12) United States Patent
Artamo et al.

(10) Patent No.: US 9,677,825 B2
(45) Date of Patent: Jun. 13, 2017

(54) SHELL AND TUBE HEAT EXCHANGER

(75) Inventors: Arvi Artamo, Veikkola (FI); Pentti Juhola, Espoo (FI)

(73) Assignee: RINHEAT OY, Espoo (FI)

( * ) Notice: Subject to any disclaimer, the term of this patent is extended or adjusted under 35 U.S.C. 154(b) by 309 days.

(21) Appl. No.: 13/992,903

(22) PCT Filed: Dec. 9, 2011

(86) PCT No.: PCT/FI2011/051095

§ 371 (c)(1),
(2), (4) Date: Jun. 10, 2013

(87) PCT Pub. No.: WO2012/085337

PCT Pub. Date: Jun. 28, 2012

(65) Prior Publication Data

US 2013/0255923 A1 Oct. 3, 2013

(30) Foreign Application Priority Data

Dec. 21, 2010 (EP) ..... 10397525

(51) Int. Cl.
*F28F 9/013* (2006.01)
*F28F 9/00* (2006.01)
*F28D 7/16* (2006.01)

(52) U.S. Cl.
CPC ..... *F28F 9/00* (2013.01); *F28D 7/16* (2013.01); *F28F 9/0136* (2013.01)

(58) Field of Classification Search
CPC ..... F28F 9/013; F28F 9/0135; F28F 9/0136; F16L 3/22; F16L 3/221; F16L 3/222; F16L 3/223

(Continued)

(56) References Cited

U.S. PATENT DOCUMENTS 2,653,014 A 9/1953 Sniader
3,545,537 A * 12/1970 Hill, Jr. ..... F22B 37/206 122/510

(Continued)

FOREIGN PATENT DOCUMENTS

DE 930 146 A 7/1955
GB 26 759 A 0/1897

(Continued)

OTHER PUBLICATIONS

Wellington Tube Works Limited, (GB 764,866), Publication Date Jan. 2, 1957.*

(Continued)

*Primary Examiner* — Allen Flanigan
(74) *Attorney, Agent, or Firm* — Young & Thompson

(57) ABSTRACT

A shell and tube heat exchanger include heat surface tubes (6) surrounded by a shell (1), the tubes communicating with an inlet end chamber (11) through a tube sheet (5) at one end and with an outlet end chamber (12) through a tube sheet at the other end, and in the shell side of the tube heat exchanger there is at least one baffle plate made of flat strips for supporting the heat surface tubes and guiding the shell-side flow. The flat strips forming the baffle plate are straight and thinner than the distance between the tubes to be supported, and the required support is achieved by placing each flat strip of the baffle plate in an inclined position with respect to the heat surface tubes so that one of the crosswise edges of the flat strip is supporting one and the other is supporting the other of adjacent tubes.

9 Claims, 3 Drawing Sheets

(58) Field of Classification Search
USPC ..... 165/162, 158
See application file for complete search history.

(56) References Cited

U.S. PATENT DOCUMENTS

| | | | | | |
|---|---|---|---|---|---|
| 3,804,161 | A | * | 4/1974 | Nowak | F28F 9/00 165/158 |
| 4,204,570 | A | | 5/1980 | Eisinger | |
| 4,359,088 | A | * | 11/1982 | Jabsen | F28F 9/0136 122/510 |
| 4,450,904 | A | * | 5/1984 | Volz | B23P 15/26 122/510 |
| 4,579,304 | A | * | 4/1986 | Williams | F28F 9/0136 165/172 |
| 4,637,455 | A | | 1/1987 | Tordonato | |
| 4,919,199 | A | | 4/1990 | Hahn | |
| 5,642,778 | A | | 7/1997 | Gentry | |

FOREIGN PATENT DOCUMENTS

| | | | |
|---|---|---|---|
| GB | 764 866 | A | 1/1957 |
| NL | 52 981 | C | 3/1942 |

OTHER PUBLICATIONS

International Search Report, dated Mar. 23, 2012, from corresponding PCT application.
EP Search Report, dated May 25, 2011, from corresponding EP application.
Written Opinion of the International Preliminary Examining authority, dated Dec. 13, 2012, from corresponding PCT application.

* cited by examiner

SHELL AND TUBE HEAT EXCHANGER

BACKGROUND OF THE INVENTION

Field of the Invention

The present invention concerns a shell and tube heat exchanger comprising heat surface tubes surrounded by a shell, said tubes communicating at one end with an inlet end chamber via a tube sheet and at the other end with an outlet end chamber via a tube sheet, and in the shell side of the heat exchanger there is at least one baffle plate made of flat strips for supporting the heat surface tubes and for guiding the shell-side flow.

Description of the Related Art

The most general solution used for guiding the shell-side flow and for supporting the heat surface tubes is to use segmental guiding/supporting baffles made of a plate. The construction and dimensioning of this kind of baffles has been well discussed e.g. in the TEMA standard (Standard of the Tubular Exchanger Manufacturers' Association). A weakness of these baffles is that in the corners formed by the heat exchanger shell and the baffle plates there are "dead areas", where the flow speed is low and the heat transfer weak, and these areas also easily get contaminated, and the support provided by them for the heat surface tubes against vibration and buckling is insufficient, especially, when tubes with a small diameter and thin walls are to be used in heat exchangers with a large diameter.

U.S. Pat. No. 5,642,778 discloses another solution for supporting heat surface tubes. There, the heat surface tubes are supported by means of an outer ring and round baffle rods attached thereto in parallel. The desired pitch and supporting of the tubes is provided by changing the thickness and number of the rods of the baffle. When the baffles are positioned crosswise, a four-point support is provided for each heat surface tube. One four-point support requires two or four sequential crosswise arrangements of rod baffles. Weaknesses of this kind of supporting are that a big amount of rod baffles is required for providing a sufficient support, the long rods of the baffles easily start vibrating, which can lead to their breaking, and that pressure loss in the shell-side is relatively high.

SUMMARY OF THE INVENTION

The object of the present invention is to develop a shell and tube heat exchanger, wherein the shell-side flow is guided so as to achieve a heat transfer as efficient as possible with a predetermined pressure loss, and at the same time a sufficient support of the heat surface tubes is provided, to prevent damaging of the tubes by vibration and/or buckling of the tubes, and to overcome the aforementioned drawbacks. This object is achieved by means of a heat exchanger that is characterized in that the flat strips forming a baffle plate are straight and thinner than the distance between the tubes to be supported, and that the required support is provided by placing each flat strip of the baffle plate in an inclined position with respect to the heat surface tubes so that one of the crosswise edges of the flat strip supports one of two adjacent tubes and the other supports the other. The flat strips are divided into two groups, the first group comprising a first set of the flat strips arranged in parallel, the second group comprising a second group of the flat strips arranged in parallel. The heat exchanger can be installed either in a vertical position or a horizontal position. Due to the baffle plate in accordance with the invention, each heat surface tube is supported at four points, and at the same time, there are no dead areas left in the construction that would be subjected to contamination and would weaken the heat transfer. Due to this kind of baffle plates, an even shell-side flow and a good heat transfer along the total length of the heat surface tubes can be achieved. The pressure loss is low, because only 10 to 20% of the cross-sectional flow area at the shell side is covered by baffle plates.

A groove parallel with the heat exchange tube can be advantageously formed or machined in the points of the flat strip edges of the baffle plates that support the heat surface tubes, in order to make the contact surface between the tube and the flat strip larger.

The heat surface tubes can either be straight, whereby the inlet end chamber is located in one end of the tube heat exchanger and the outlet end chamber is located in the other end of the tube heat exchanger, or they can be formed as a U, whereby the inlet end chamber and the outlet end chamber are located in the same end covered by a common shell so that said chambers are separated from each other by a partition wall.

Good heat transfer and low contamination combined with a small pressure loss lead to a tube heat exchanger having both a smaller heat surface and a smaller size.

The baffle plate in accordance with the invention is, in addition to one-phase flow, also applicable to use in vaporizers and condensers.

The baffle plate in accordance with the invention is also applicable for heat surface tubes with different profiles and/or fins.

BRIEF DESCRIPTION OF THE DRAWING FIGURES

The invention will be described in more detail in the following, with reference to a drawing, wherein

DETAILED DESCRIPTION OF THE INVENTION

Figure 1:
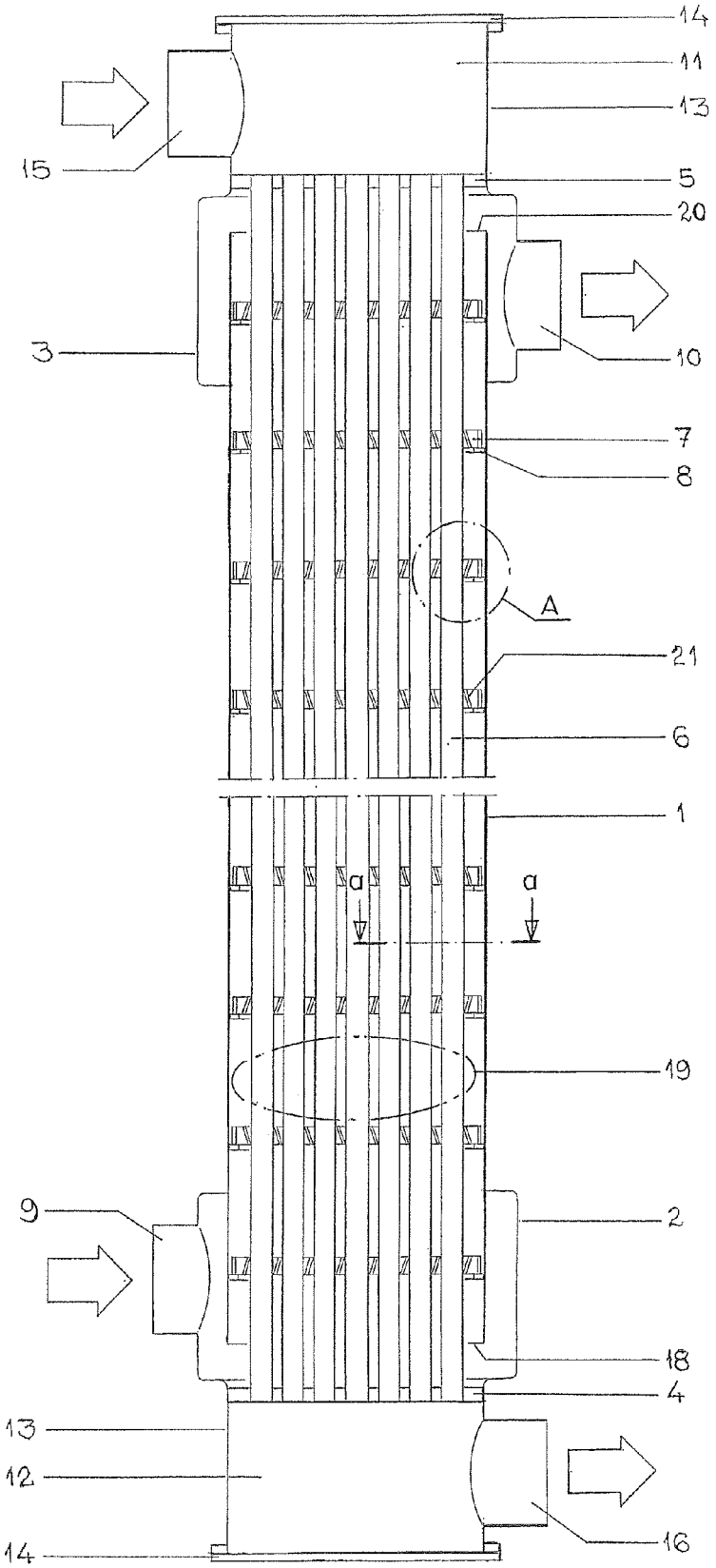
FIG. 1 shows a cross-sectional view of a single tubepass heat exchanger with straight tubes and fixed tube sheets.

The shell side of the heat exchanger is formed of a cylindrical shell 1 being connected to tube sheets 4 and 5 via expanded shell and bellow parts 2 and 3. The heat surface tubes 6 are fixed at their ends to said tube sheets 4 and 5. Baffle plates 7 arranged at predetermined distances for supporting the tubes and for guiding the flow are fixed to the shell 1 by means of rings 8. Shell-side pipe connections 9 and 10 are fixed to the expanded shell parts 2 and 3.

The tube side end chambers 11 and 12 are formed of a cylinder shell 13 and an openable end plate 14. Tube side pipe connections 15 and 16 are fixed to the shell part 13 of the chambers.

A heat exchanger according to FIG. 1 is suitable for heat transfer both for liquid and steam/gas flows.

The heat releasing medium flows to the tube side inlet end chamber 11 of the heat exchanger through the pipe connection 15 and further to the heat surface tubes 6. Medium flowing downwards in the heat surface tubes 6 cools down and is passed out from the heat exchanger through the outlet end chamber 12 and the pipe connection 16.

The heat receiving medium is led through the pipe connection 9 to the expanded lower part 2 of the shell side, where the flowing medium is distributed so as to flow under a plate edge 18 evenly over the total peripheral length around the tube bundle 19. The flowing medium fills the shell volume between the tubes and flows in this space parallel with the tubes from down upwards.

The heat surface tubes 6 pass through the baffle plates 7 according to the invention located in the shell side at predetermined distances. The baffle plates 7 support the heat surface tubes 6 and increase the turbulence of the medium flowing axially between the tubes, thus intensifying the heat transfer.

The medium which has flown from down upwards through the shell part flows over a plate edge 20 to the expanded upper part 3 of the shell side, from where it is passed out from the heat exchanger through the pipe connection 10.

Figure 2:
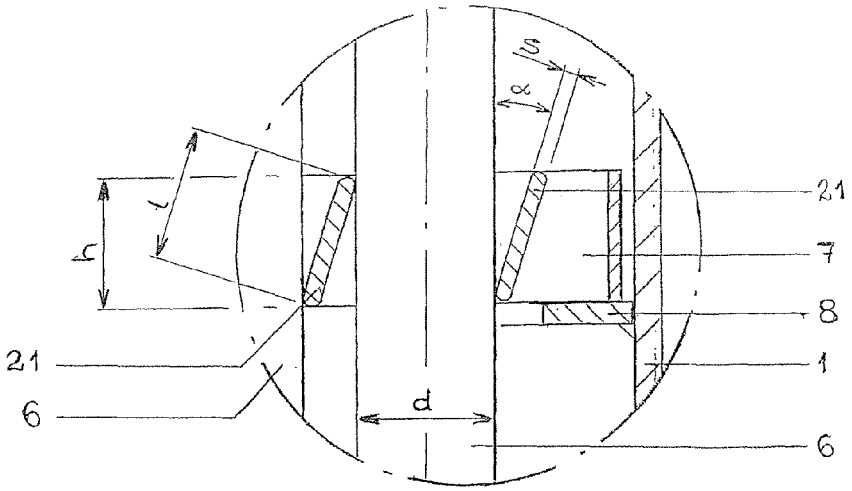
FIG. 2 shows an enlarged detail A of FIG. 1.

The baffle plates 7 according to the invention are formed of thin straight slotted and inclined flat strips 21 placed crosswise. The slots in the strips fix the crossing strips to each other and make the grid baffle rigid. FIG. 2 shows how the flat strip 21 of the baffle plate 7 is inclined for an angle $\alpha$, whereby the left lower edge of the strip 21 supports one and the right upper edge another heat surface tube 6. The thickness s, the width 1 and the angle $\alpha$ of the flat strip 21, can be changed in order to provide a desired guiding and supporting baffle.

Figure 3:
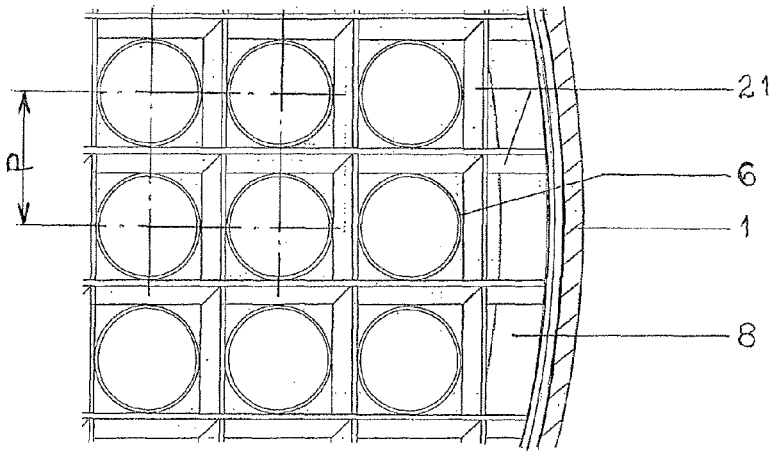
FIG. 3 shows an enlarged section a-a of FIG. 1.
Figure 4:
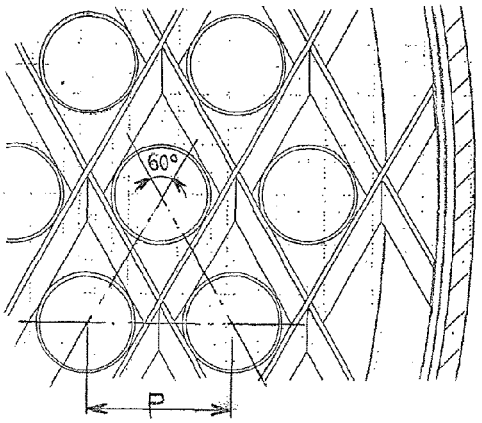
FIG. 4 shows a corresponding section as in FIG. 1, where the heat surface tubes are arranged in the form of an equilateral triangle.

FIG. 3 shows the construction of a baffle plate 7 providing four point support, when the heat surface tubes 6 are arranged in a square form, and FIG. 4 shows the construction of a baffle plate 7, when the arrangement of the heat surface tubes 6 has the form of an equilateral triangle.

In FIG. 1, the baffle plate 7 is supported onto a ring 8 fixed to the shell 1. The ring acts at the same time as a sealing strip preventing the flow from passing by the tube bundle 19. The baffle plates 7 can also be supported by means of tie rods, like the plate shaped guiding/support baffles in conventional shell and tube heat exchangers.

Points of the baffle plates 7 left without tubes can either be made of a plate or be covered by a (thin) sheet for preventing detrimental bypass and leakage flows. For decreasing the pressure loss caused by the baffle plate 7, it is advantageous to chamfer the edges of the flat strips forming the baffle plate 7, as shown in FIG. 2.

Figure 5:
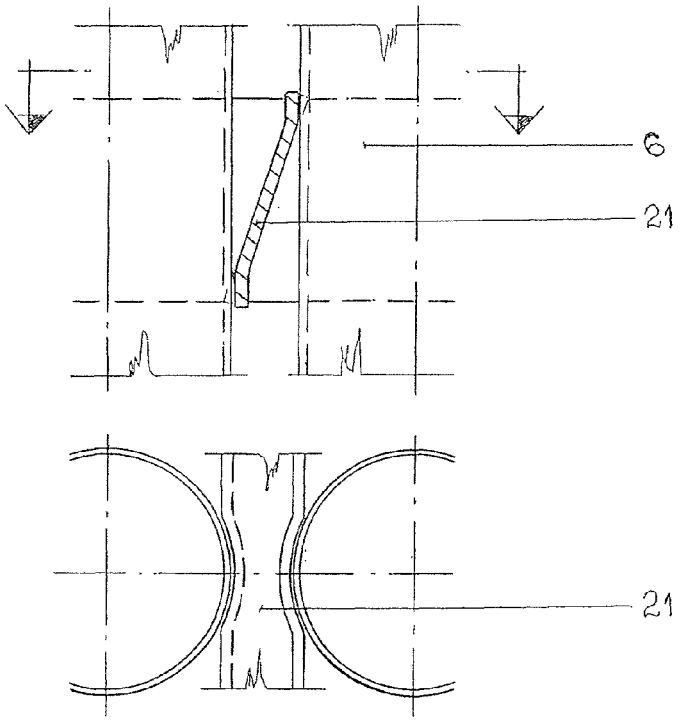
FIG. 5 shows an example, how the edges of the flat strip of the baffle plate can be formed at the contact point with the heat surface tubes.

The support surface at the contact point between the flat strip 21 of the baffle plate 7 and the heat surface tube 6 can be increased e.g. as shown in FIG. 5. It shows a groove pressed to the edge of the strip 21 at the contact point with the tube 6 to be supported, corresponding to the curvature of the tube, whereby the contact surface of the flat strip 21 with the tube is increased both in the lateral and in the vertical direction.

Figure 6:
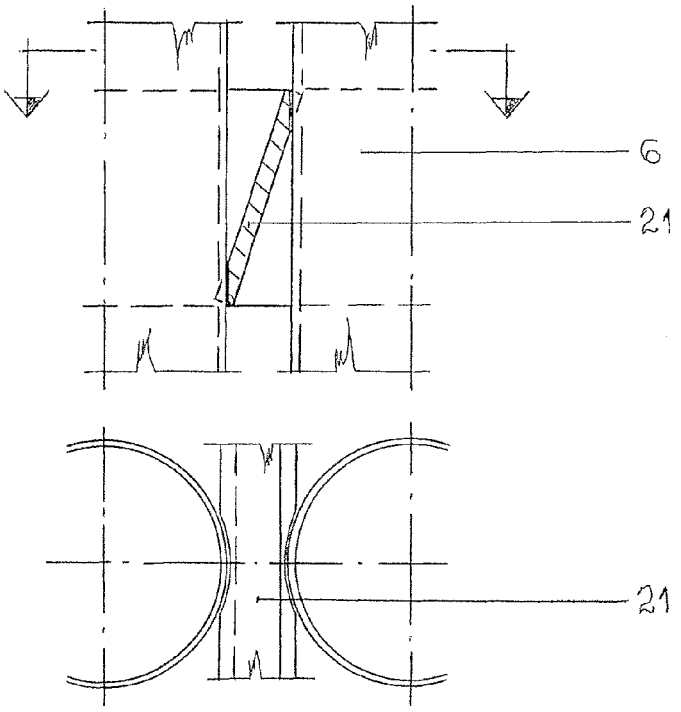
FIG. 6 shows an example, how the edges of the flat strip of the baffle plate can be machined at the contact point with the heat surface tubes.

In FIG. 6, the corresponding groove in the edge of the flat strip 21 has been made e.g. by grinding. A larger support surface supports the tube 6 better and enables the use of tubes being corrugated, profiled or finned in various ways in the heat exchangers according to the invention.

The invention claimed is:

1. A shell and tube heat exchanger comprising:

a shell;

heat surface tubes surrounded by the shell and extending along a longitudinal axis, said heat surface tubes having a tube pitch and communicating with an inlet end chamber through a first tube plate at one end and with an outlet end chamber through a second tube plate at an opposite, other end; and at least one baffle plate in a shell side of the tube heat exchanger;

flat strips comprising the at least one baffle plate, the flat strips being straight and having a constant width, the flat strips being divided into two groups, the first group comprising a first set of the flat strips arranged in parallel, the second group comprising a second group of the flat strips arranged in parallel the second set of strips being arranged cross-wise with respect to the first set of strips, said first set of flat strips and said second set of flat strips each defining leading and trailing edges, wherein the respective leading and trailing edges of the first set of flat strips and the second set of flat strips are in a same plane, the flat strips support the heat surface tubes and guide the shell-side flow, the flat strips are thinner than a distance between the tubes to be supported, required support is provided by placing each flat strip of the baffle plate at an inclined position at an angle (a) with respect to the longitudinal axis of said heat surface tubes, each heat surface tube passing through the baffle plate being supported by portions of the flat strips disposed at or adjacent the leading or trailing edges of the flat strips to thereby engage the periphery of the heat surface tubes at four points.

2. The shell and tube heat exchanger according to claim 1, wherein at the edges of the flat strips of the baffle plate there is a groove parallel with the heat surface tube at the points supporting the heat surface tubes, said groove enlarging the contact surface between the heat surface tube and the flat strip.

3. The shell and tube heat exchanger according to claim 1, wherein the heat surface tubes are straight, whereby the inlet end chamber is located in one end of the tube heat exchanger and the outlet end chamber in the opposite end of the tube heat exchanger.

4. The shell and tube heat exchanger according to claim 2, wherein the heat surface tubes are straight, whereby the inlet end chamber is located in one end of the tube heat exchanger and the outlet end chamber in the opposite end of the tube heat exchanger.

5. The shell and tube heat exchanger according to claim 1, wherein the at least one baffle plate is fixed to the shell by a ring.

6. The shell and tube heat exchanger according to claim 1, wherein the shell is a cylindrical shell connected to the tube plates via expanded shell and bellow parts.

7. The shell and tube heat exchanger according to claim 6, wherein shell side pipe connections are fixed to the expanded shell and bellow parts.

8. The shell and tube heat exchanger according to claim 1, wherein the shell is a cylindrical shell, and the end chambers are formed from the cylindrical shell.

9. The shell and tube heat exchanger according to claim 8, wherein the end chambers have an openable end plate.

* * * * *